US012687086B2

(12) United States Patent
Guven et al.

(10) Patent No.: US 12,687,086 B2
(45) Date of Patent: Jul. 21, 2026

(54) ELECTRIC COMPLETION SYSTEM AND METHODOLOGY

(71) Applicant: Schlumberger Technology Corporation, Sugar Land, TX (US)

(72) Inventors: Oguzhan Guven, Rosharon, TX (US); David Lardy, Rosharon, TX (US); Robert Krush, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/717,376

(22) PCT Filed: Dec. 2, 2022

(86) PCT No.: PCT/US2022/051644

§ 371 (c)(1),
(2) Date: Jun. 6, 2024

(87) PCT Pub. No.: WO2023/107341

PCT Pub. Date: Jun. 15, 2023

(65) Prior Publication Data

US 2025/0043651 A1 Feb. 6, 2025

Related U.S. Application Data

(60) Provisional application No. 63/286,983, filed on Dec. 7, 2021.

(51) Int. Cl.

| | |
|---|---|
| ***E21B 33/124*** | (2006.01) |
| ***E21B 34/06*** | (2006.01) |
| ***E21B 43/02*** | (2006.01) |

(52) U.S. Cl.

CPC ..... *E21B 33/124* (2013.01); *E21B 34/066* (2013.01); *E21B 43/02* (2013.01)

(58) Field of Classification Search

CPC .. E21B 33/124; E21B 34/066; E21B 41/0085; E21B 43/02

See application file for complete search history.

(56) References Cited

U.S. PATENT DOCUMENTS

| | | | |
|---|---|---|---|
| 5,706,896 | A | 1/1998 | Tubel |
| 6,176,312 | B1 | 1/2001 | Tubel |

(Continued)

FOREIGN PATENT DOCUMENTS

| | | | |
|---|---|---|---|
| WO | 2019246501 | A1 | 12/2019 |
| WO | 2021173684 | A1 | 9/2021 |

OTHER PUBLICATIONS

Search Report and Written Opinion of International Patent Application No. PCT/US2022/051644 Dated Apr. 19, 2023, 10 Pages.

*Primary Examiner* — Nicole Coy
*Assistant Examiner* — Nicholas D Wlodarski
(74) *Attorney, Agent, or Firm* — Kyle R. Miiller

(57) ABSTRACT

A technique facilitates construction and operation of electric completion systems which may be used in the oil and gas industry. The technique is able to eliminate some or all hydraulic lines and replace them with electric lines. Depending on the application, the electric power may be provided via a surface-based power source and/or a downhole power storage/generation source. Corresponding completion components, such as control valves, subsurface safety valves, gauges, and/or other completion tools, are electrically operated via power and communication provided through the electric lines and/or wireless telemetry without the cost and complexity of hydraulic control lines and downhole hydraulic components.

20 Claims, 8 Drawing Sheets

(56) References Cited

U.S. PATENT DOCUMENTS

| | | | | |
|---|---|---|---|---|
| 6,442,542 | B1 | 8/2002 | Ramani | |
| 6,498,988 | B1 | 12/2002 | Robert | |
| 6,591,199 | B2 | 7/2003 | Tremblay | |
| 6,684,952 | B2 | 2/2004 | Brockman | |
| 6,907,375 | B2 | 6/2005 | Guggari | |
| 7,165,618 | B2 | 1/2007 | Brockman | |
| 7,735,555 | B2 | 6/2010 | Patel | |
| 7,866,414 | B2 | 1/2011 | Patel | |
| 8,074,743 | B2 | 12/2011 | Patel | |
| 8,082,983 | B2 | 12/2011 | Patel | |
| 8,330,617 | B2 | 12/2012 | Chen | |
| 8,453,723 | B2 | 6/2013 | Smithson | |
| 8,469,084 | B2 | 6/2013 | Clark | |
| 8,590,609 | B2 | 11/2013 | Smithson | |
| 8,596,359 | B2 | 12/2013 | Grigsby | |
| 8,733,448 | B2 | 5/2014 | Skinner | |
| 9,140,101 | B2 | 9/2015 | Scott | |
| 2004/0173362 | A1* | 9/2004 | Waithman | E21B 34/066 166/386 |
| 2008/0190604 | A1 | 8/2008 | Hild | |
| 2009/0045974 | A1 | 2/2009 | Patel | |
| 2013/0061899 | A1 | 3/2013 | Tosi | |
| 2014/0338922 | A1* | 11/2014 | Lopez | E21B 34/066 166/373 |
| 2015/0107901 | A1 | 4/2015 | Eriksson | |
| 2016/0170417 | A1 | 6/2016 | Sun, Jr. | |
| 2016/0290063 | A1* | 10/2016 | Richards | E21B 17/0283 |
| 2016/0312552 | A1 | 10/2016 | Early | |
| 2016/0356095 | A1 | 12/2016 | Perez | |
| 2018/0266219 | A1* | 9/2018 | Coffin | E21B 43/088 |
| 2021/0062626 | A1 | 3/2021 | Jordan, Jr. | |
| 2021/0355799 | A1* | 11/2021 | Greci | E21B 43/08 |
| 2024/0280002 | A1* | 8/2024 | El Mallawany | E21B 47/12 |

* cited by examiner

ELECTRIC COMPLETION SYSTEM AND METHODOLOGY

CROSS-REFERENCE TO RELATED APPLICATIONS

The present application is a national stage entry under 35 U.S.C. § 371 of International Application No. PCT/US2022/051644, filed on Dec. 2, 2022, which claims priority benefit of U.S. Provisional Application No. 63/286,983, filed Dec. 7, 2021, the entirety of which is incorporated by reference herein and should be considered part of this specification.

BACKGROUND

In many well applications, various types of well completion systems are deployed downhole for use in well preparation, well servicing/treatment, and/or production. A well completion system may comprise many types of tubing, valves, tools, and other components assembled in a well completion string for use in the downhole environment. Many of the valves, tools, and other components are hydraulically actuated via hydraulic actuating fluid supplied downhole through hydraulic control lines. However, hydraulic control lines and the corresponding hydraulically operated components can create substantial additional cost, complexity, and reliability issues.

SUMMARY

In general, a system and methodology are provided for facilitating construction and operation of electric completion systems which may be used in the oil and gas industry. The technique is able to eliminate some or all hydraulic lines and replace them with electric lines and/or wireless telemetry. Depending on the application, the electric power may be provided via a surface-based power source and/or downhole power storage/generation source. Corresponding completion components, such as control valves, subsurface safety valves, gauges, and/or other completion tools, are electrically operated via power and communication provided through the electric lines and/or wireless telemetry without the cost and complexity of hydraulic control lines and downhole hydraulic components.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for facilitating construction and operation of electric completion systems which may be used in the oil and gas industry. In some embodiments, the electric completion system may be fully electric so as to eliminate all hydraulic lines and replace them with electric lines and/or wireless telemetry. This type of electric completion system provides a dependable and easily controllable system which helps manage production operations. In subsea applications, the electric completion system also reduces the subsea tree footprint, reduces umbilical complexity, increases installation efficiency, and reduces risk during production life. Many of these advantages also apply to use of the electric completion system in non-subsea applications.

Embodiments of the electric completion system also provide an ability to control the flow rate through each well zone independently when production and/or treatment operations are performed through a plurality of well zones. During production, the ability to easily control the flow rate through each independent well zone allows operators to mitigate risk of premature water or gas breakthrough.

Depending on the parameters of a given application, the technique is able to eliminate some or all hydraulic lines and replace them with electric lines and/or wireless telemetry. Additionally, the electric power may be provided via a surface-based power source and/or downhole power storage/generation source. Corresponding completion components, such as control valves, subsurface safety valves, gauges, and/or other completion tools, may be electrically operated via power and communication provided through the electric lines and/or wireless telemetry without the cost and complexity of hydraulic control lines and downhole hydraulic components. Similarly, a variety of surface and subsea infrastructure systems and components also may be employed to support the electric completion system, e.g. the fully electric completion system.

Figure 1:
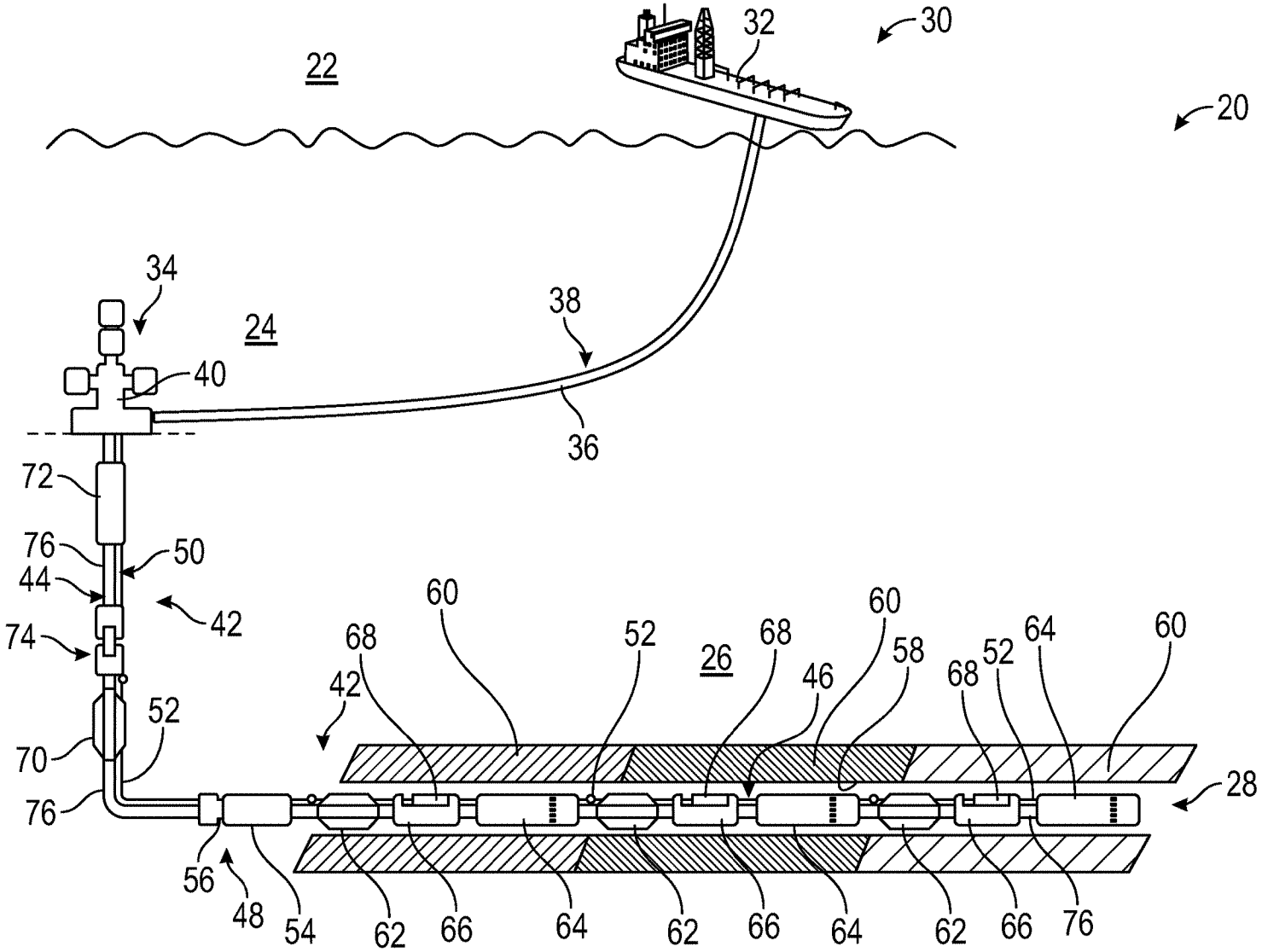
FIG. 1 is a schematic illustration of an example of a subsea well system including an electric completion system deployed downhole in a borehole, e.g. a wellbore, according to an embodiment of the disclosure.

Referring generally to FIG. 1, an example of a well system 20 is illustrated. In this embodiment, the well system 20 is located through three different regions, including a topside region 22, a subsea region 24, and a downhole region 26 having at least one borehole 28, e.g. a wellbore. At topside region 22, the well system 20 may comprise a surface facility 30, such as a ship 32. The surface facility 30 may be connected with a subsurface infrastructure 34 via, for example, an umbilical 36 or other type of communication line and/or associated tubing 38. The subsea infrastructure 34 may comprise a variety of components selected and constructed to accommodate intelligent well interface standardization (IWIS). Additionally, the subsea infrastructure 34 may include a wellhead 40 employed to provide access and communication with the wellbore 28.

In this example, an electric completion system 42 is located downhole from wellhead 40 in wellbore 28. According the embodiment illustrated, the electric completion system 42 is an all electric system which completely eliminates hydraulic control lines. The electric completion system 42 may comprise an upper completion 44 connected with a lower completion 46 via a suitable coupling system 48. In some well operations, the lower completion 46 may be located substantially in a deviated, e.g. horizontal, section of wellbore 28.

Additionally, the electric completion system 42 comprises an electric line system 50 routed along both the upper completion 44 and the lower completion 46 and including the desired number of electric lines 52 (and sometimes one or more optical fiber lines) for providing power and communication throughout the electric completion system 42. In this example, the coupling system 48 may comprise an inductive coupler 54 to enable communication of electric power and electrical signals between the upper completion 44 and the lower completion 46. In some embodiments, the coupling system 48 also may comprise or be in the form of a hydraulic wet mate connection 56. The hydraulic wet mate connection 56 also may be directed to enable chemical injection via a chemical injection line(s).

The electric completion system 42 may be used in many types of environments to facilitate a variety of well operations. In some embodiments, at least the lower completion 46 may be in the form of an open hole completion disposed in an open hole section 58 of wellbore 28. This type of application may be used in, for example, a carbonate formation where the use of sand control components is not included in the lower completion. The open hole section 58 is formed without casing along the wellbore 28. However, embodiments of electric completion system 42 also may be configured for use in cased boreholes 28.

As illustrated, the lower completion 46 may be disposed along a plurality of well zones 60 and may include a plurality of isolation packers 62 positioned to isolate the individual well zones 60. Additionally, the lower completion 46 may comprise a variety of other components positioned in each of the well zones 60. For example, the lower completion 46 may comprise an electric flow control valve 64 located to control flow in each well zone 60. Each electric flow control valve 64 may be in the form of an internal flow control valve or other suitable, electronically control valve arranged to control inflow and/or outflow of fluids.

In this example, the lower completion 46 also comprises at least one monitoring station 66 positioned in each well zone 60. Depending on the parameters of the specific well operation, each monitoring station 60 may comprise various types of sensor devices 68, e.g. pressure sensors, temperature sensors, vibration sensors, and/or various gauges for monitoring conditions downhole. At least one sensor 68, e.g. a plurality of sensors 68, may be positioned along each well zone 60. One or more of the electric lines 52 may be routed along the lower completion 46 and may be connected to the electric flow control valves 64 and monitoring stations 66 to enable communication of power and/or data signals. These one or more electric lines 52 may be connected to their corresponding electric lines 52 of upper completion 44 via coupling system 48. It should be noted the lower completion 46 may comprise many other types of electric components, e.g. electrically powered components, including various other types of valves and downhole tools.

With additional reference to FIG. 1, the upper completion 44 also may comprise many types of components. Examples of upper completion components comprise a production packer 70 and an electric subsurface safety valve 72. In some embodiments, the components of lower completion 46 are controlled via a dedicated electric line 52 or multiple electric lines 52 while the electric subsurface safety valve 72 is controlled via a separate electric line 52. The number of electric lines 52 utilized in electric line system 50 may vary depending on the number of components, types of components, well environment, and operational parameters for a given well operation.

According to the illustrated example, the upper completion 44 may comprise a wireless system 74 which can provide power and telemetry/communication over a short section of the upper completion 44. Some systems may utilize continuous electric line connections for transfer of electrical power while wireless system 74 may be used for the communication of data/telemetry. Various components of both upper completion 44 and lower completion 46 may be connected via tubing 76 (or other suitable tubular structures) which can be used to accommodate the down flow and up flow of fluid during various well operations.

Figure 2:
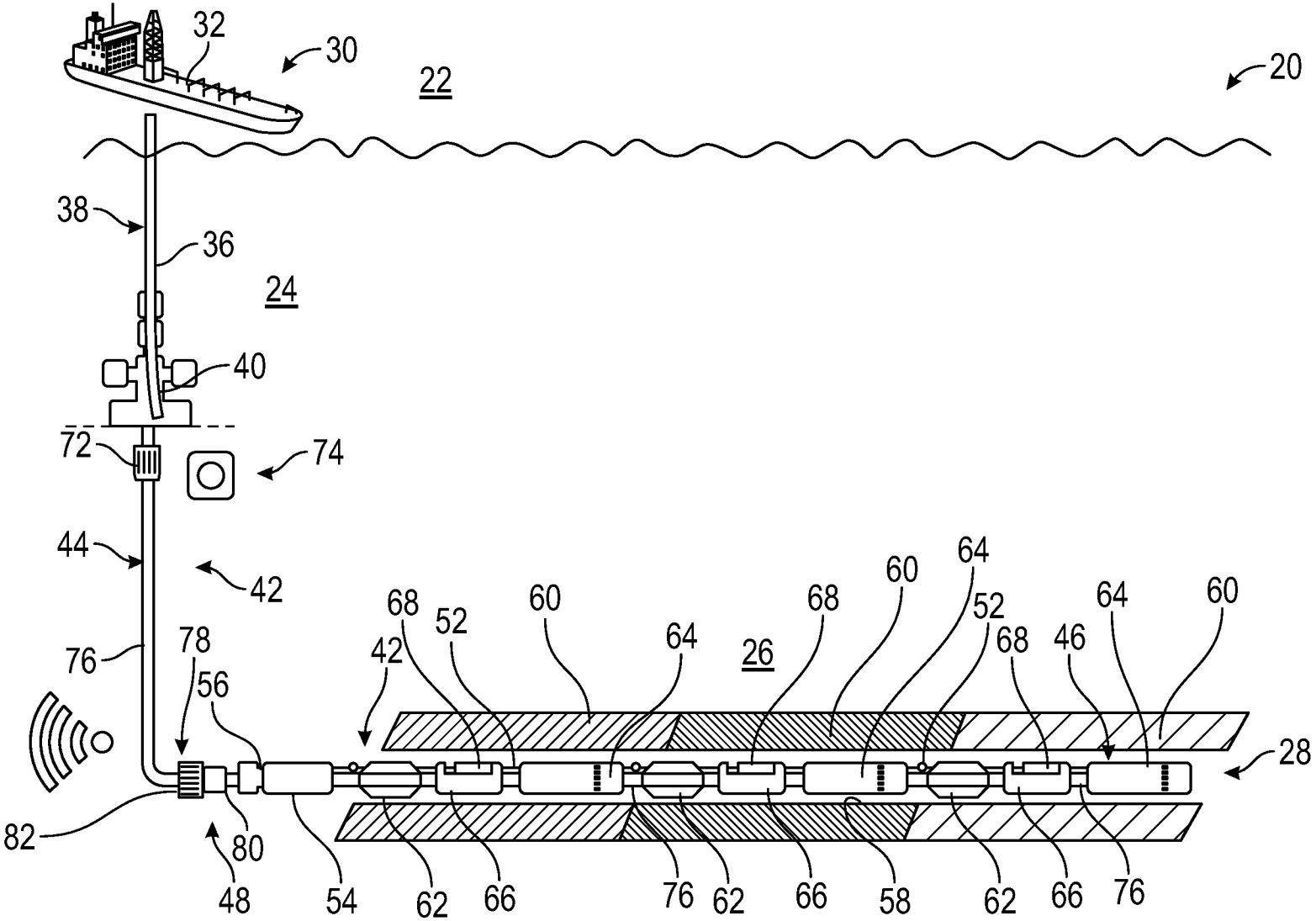
FIG. 2 is a schematic illustration of another example of a subsea well system including an electric completion system, according to an embodiment of the disclosure.

Referring generally to FIG. 2, another embodiment of well system 20 is illustrated. In this example, the lower completion 46 may be the same or similar to that described with reference to FIG. 1. However, the upper completion 44 is completely wireless. It should be noted that this type of system may still employ the electric subsurface safety valve 72 which may be wired to a dedicated electric line 52 extending to the surface.

According to the embodiment of FIG. 2, the telemetry to lower completion 46 may be achieved via a longer distance wireless system 74 constructed to utilize suitable wireless communication techniques, such as acoustic telemetry, electro-magnetic telemetry, or mud pulse telemetry. The electrical power for devices disposed along the lower completion 46 may be obtained via at least one downhole power device 78 capable of providing electrical power to downhole devices over an extended period of time via, for example, electric line system 50 located in lower completion 46. The downhole power device 78 may be in the form of a power storage device 80 and/or a power generation device 82. By way of example, the power generation device 82 may be in the form of a power generator driven by flow of hydrocarbons along the interior of tubing 76.

Figure 3:
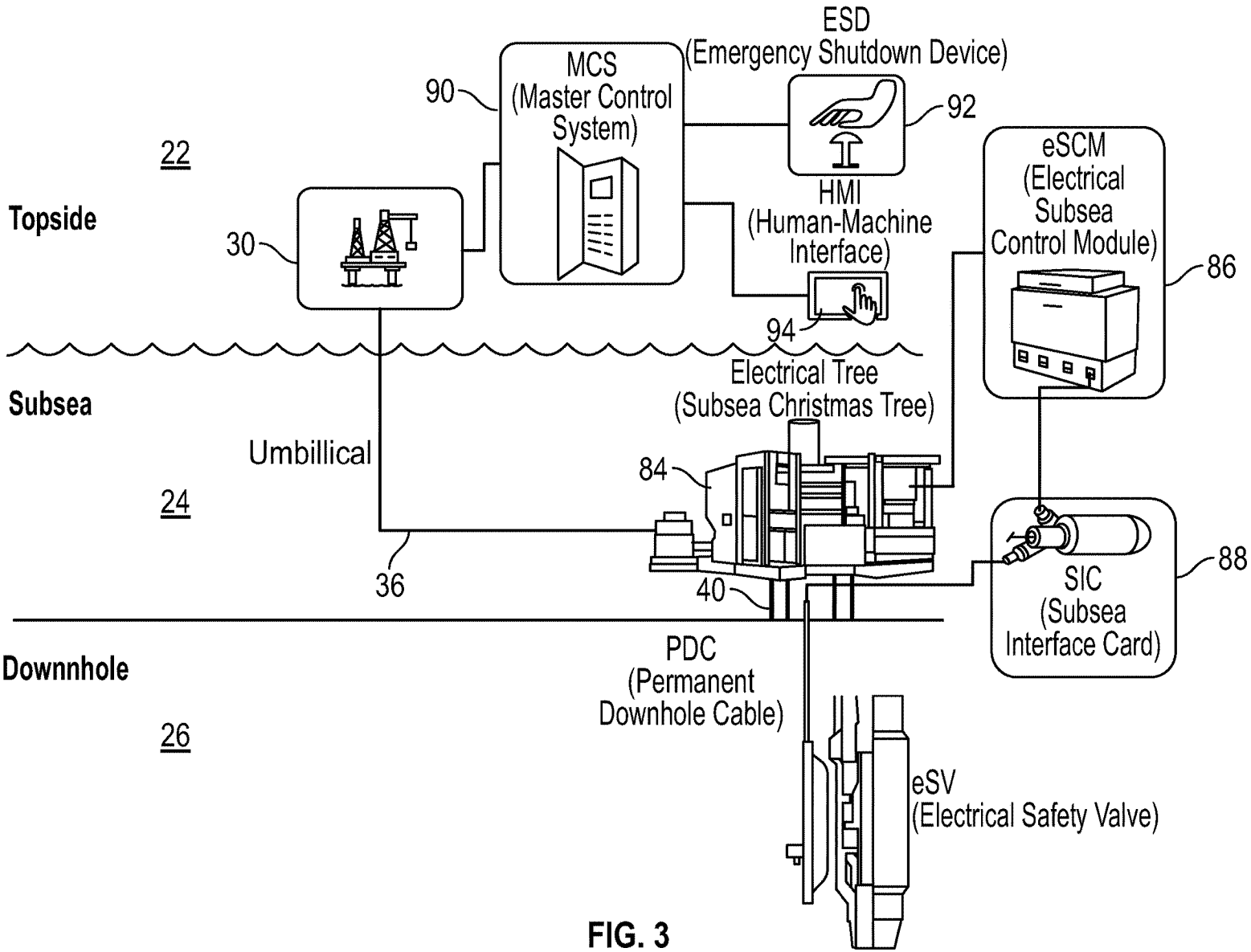
FIG. 3 is a schematic illustration of an example of an electrical control system structure which may be used with downhole electric completion systems including various electrical components, e.g. an electrical safety valve, according to an embodiment of the disclosure.

Referring generally to FIG. 3, an example of subsea infrastructure 34 is illustrated as comprising a variety of components which may be located in subsea region 24. However, the subsea infrastructure 34 may include or may be coupled with various other electric control components which may be located topside in topside region 22 on a given ship 32 or other surface facility 30. In this example, the subsea infrastructure 34 comprises an electrical tree 84, e.g. an electrical subsea Christmas tree, connected with wellhead 40.

Additionally, the electrical tree 84 may be connected with, or may comprise, an electrical subsea control module 86 and a subsea interface card 88. The electrical subsea control module 86 and subsea interface card 88 are part of the subsea infrastructure 34 configured to control electrical power and/or communication with downhole electrical devices such as electric subsurface safety valve 72 as well as various other electrical components along electric completion system 42. In this example, the electrical tree 84 also is connected to the appropriate surface facility 30 via umbilical 36.

The surface facility 30 also may comprise various components for controlling the power and/or electrical communication with the electrical devices of electric completion system 42. Examples of such components include a master control system 90 which may be connected with an emergency shutdown device 92 and also with a human machine interface 94. The human machine interface 94 allows a human operator to input desired instructions and to obtain desired data with respect to the downhole operation.

Figure 4:
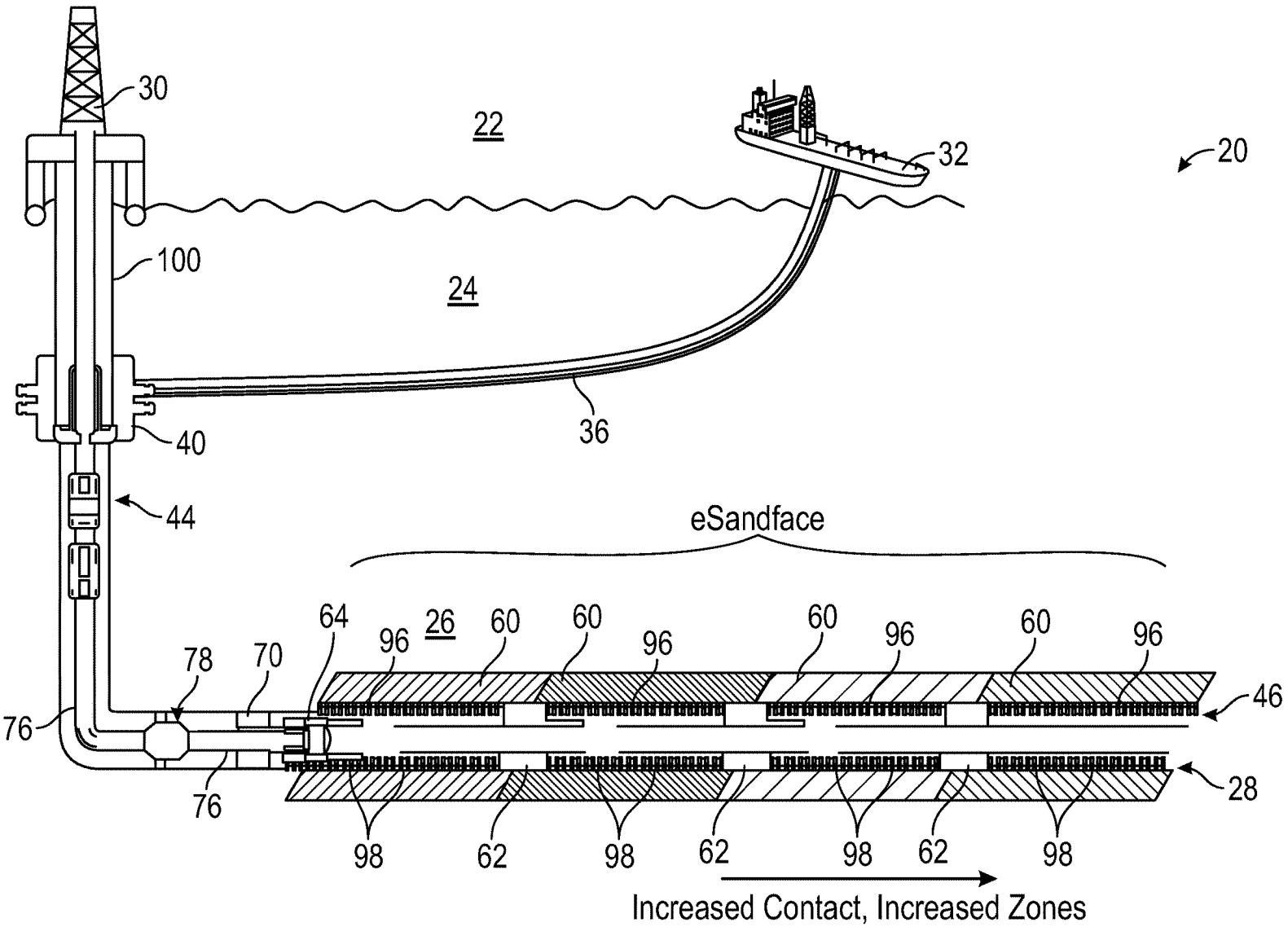
FIG. 4 is a schematic illustration of another example of a subsea well system including an electric completion system, according to an embodiment of the disclosure.

Referring generally to FIG. 4, another embodiment of well system 20 is illustrated. In this example, the electric completion system 42 is similarly a fully electric completion but the configuration is suitable for use in sandstone type formations were sand control is employed. Accordingly, the lower completion 46 may be configured with a sand control system comprising sand control assemblies 96 having suitable sand screens 98 deployed in the various well zones 60.

The components of lower completion 46 may vary substantially depending on the specific wellbore environment and on parameters of the specific well operation. For example, the lower completion 46 may be configured to be compatible with an open hole gravel pack architecture or a stand-alone screen type of architecture. Additionally, the coupling system 48 may be in the form of a wet mate coupling system able to connect electric lines 52 between the upper completion 44 and the lower completion 46 while also accommodating coupling of other types of control lines, such as fiber-optic lines and/or chemical injection lines.

In some applications, the well system 20 may comprise a riser 100 extending generally from wellhead 40 to the surface facility 30 to facilitate hydrocarbon production along the interior of tubing 76. Electric power and/or communication may be communicated via, for example, umbilical 36 extending to surface ship 32. However, various types of downhole power devices 78 may be positioned at desired locations downhole to provide electrical power to downhole devices, e.g. electric flow control valve 64, of the lower completion 46 (and/or other downhole components).

Figure 5:
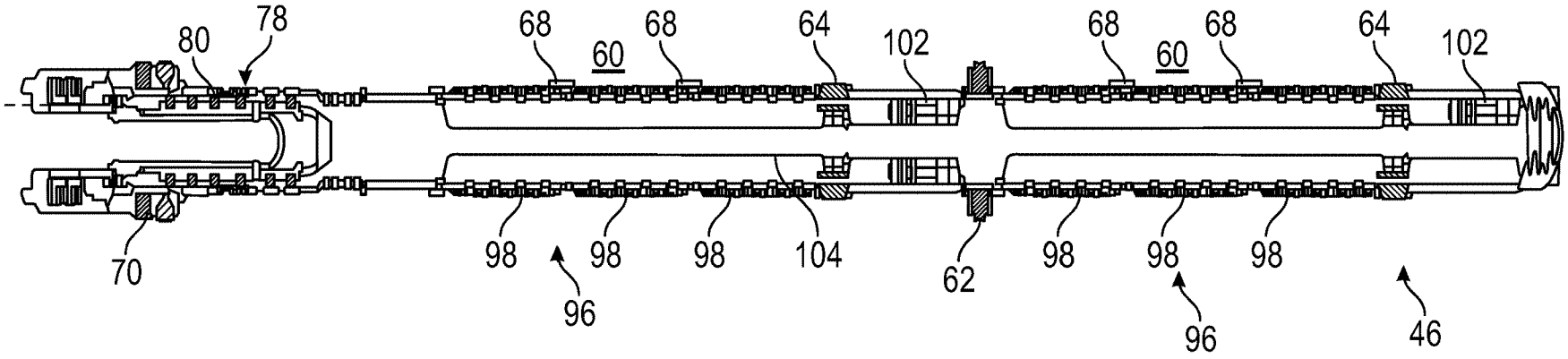
FIG. 5 is a cross-sectional schematic view of an example of an electric completion system for use in a borehole, e.g. a wellbore, according to an embodiment of the disclosure.

As referenced above, the lower completion 46 may have many configurations for use in sand producing formations. FIGS. 5-8 illustrate various examples of lower completion 46 which utilize different types of sand control assemblies 96. In FIG. 5, for example, the lower completion 46 is a completely electric open hole gravel pack architecture which comprises sand control assemblies 96 with screens 98 in combination with electronic flow control valves 64 and electronic flow control chokes 102 positioned in each sand control assembly 96. Accordingly, inflow of production fluids (as well as gravel packing returns) may be controlled electrically and independently at each well zone 60.

With this type of system, a desired gravel pack may be achieved using shunt tubes which are part of an alternate path system located outside the screens 98 so as to bypass the electronic flow control valves 64. In this example, an inner tubing string 104 is used to provide a flow path for returning gravel packing flows and production flows. Various flow path configurations may be constructed. For this type of architecture, no wash pipe service tool is needed for gravel packing. It should be noted various types of sensors 68 may be deployed along the lower completion 46. Electrical power for the lower completion devices, such as electronic flow control valves 64 and electronic flow control chokes 102 may be provided via electric lines 52 routed at least in part from the surface and/or from downhole power device 78, e.g. a downhole storage device/battery 80.

Figure 6:
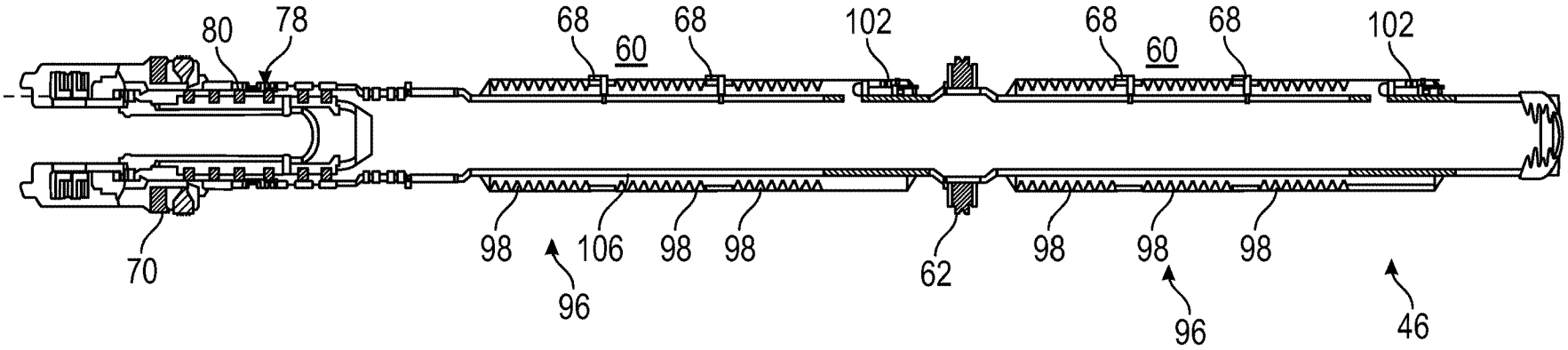
FIG. 6 is a cross-sectional schematic view of another example of an electric completion system for use in a borehole, e.g. a wellbore, according to an embodiment of the disclosure.

The embodiment illustrated in FIG. 6 shows a different open hole gravel pack architecture for electric lower completion 46. In this example, hydrocarbon flow space is provided between screens 98 and a non-perforated base pipe 106 until the flow at each well zone 60 reaches the corresponding electric flow control choke 102 which controls flow into the interior of base pipe 106. This type of architecture eliminates the need for inner tubing string 104.

Figure 7:
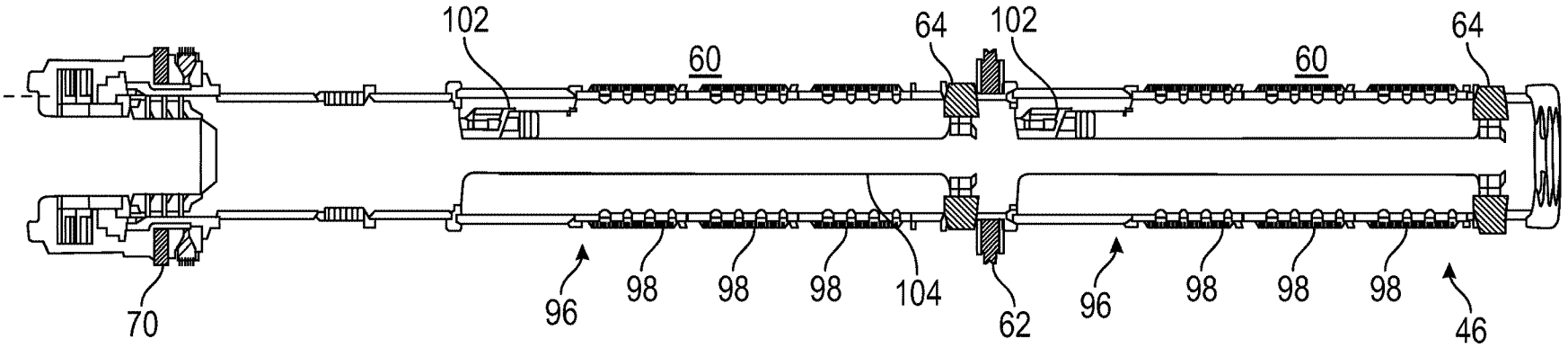
FIG. 7 is a cross-sectional schematic view of another example of an electric completion system for use in a borehole, e.g. a wellbore, according to an embodiment of the disclosure.
Figure 8:
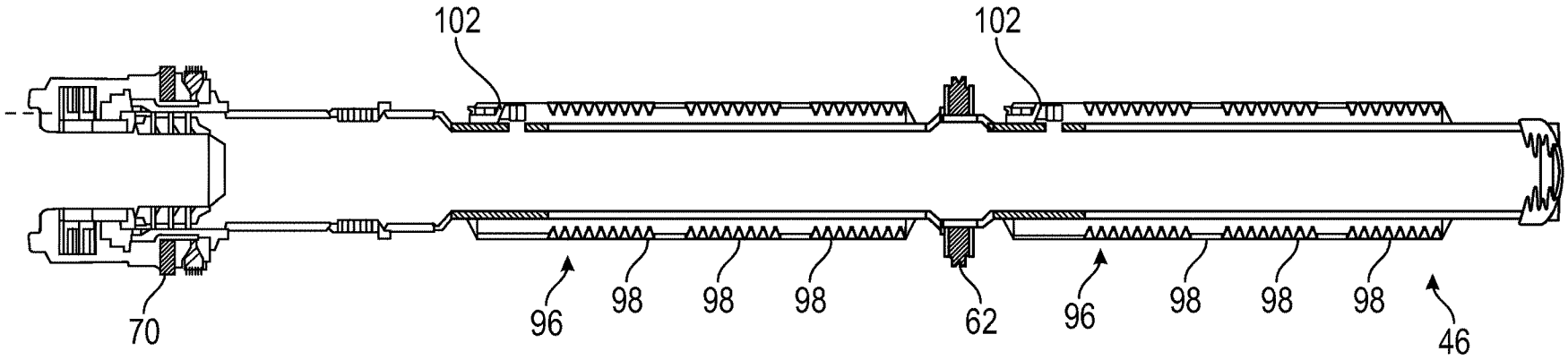
FIG. 8 is a cross-sectional schematic view of another example of an electric completion system for use in a borehole, e.g. a wellbore, according to an embodiment of the disclosure.

In FIGS. 7 and 8, similar embodiments of electric lower completion 46 are illustrated as utilizing inner tubing string 104 and non-perforated base pipe 106, respectively. In these embodiments, however, the sand control assemblies 96 utilize screens 98 in the form of stand alone screens. The stand alone screens 98 may be used in a variety of wellbore environments including open hole wellbores 28. Again, many types of sensors 68 may be positioned along the lower completion 46 and connected with a suitable electric line or lines 52 to provide and/or receive communication data.

It should be noted the electric line system 50 also may comprise fiber-optic lines or other types of communication lines in the embodiments described herein. Additionally, portions of the power/communication path to the surface may utilize a wireless system or systems 74 to achieve wireless communication of power and/or data communication. The wireless system or systems 74 may be placed at desired locations to form portions of the power/communication path along the upper completion 44 and/or the lower completion 46.

Figure 9:
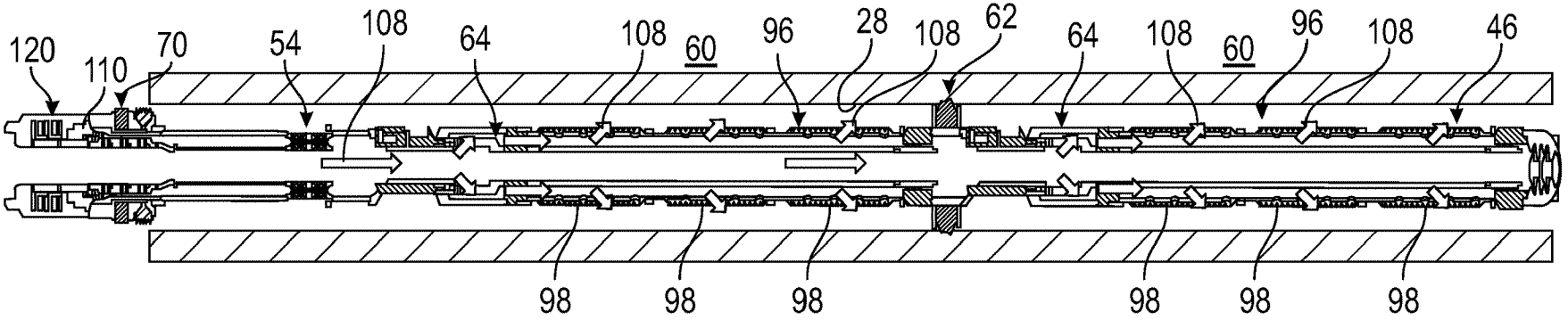
FIG. 9 is a cross-sectional schematic view of another example of an electric completion system for use in a borehole, e.g. a wellbore, according to an embodiment of the disclosure.

Referring generally to FIGS. 9-12, additional embodiments of electric lower completion 46 are illustrated. These embodiments may contain certain components and architectures similar to embodiments described above and common reference numerals have been used. In FIG. 9, an embodiment of lower completion 46 is illustrated in which fluid to be injected may be flowed down through an interior of the lower completion 46 and then directed outwardly through screens 98, as indicated by arrows 108.

Figure 10:
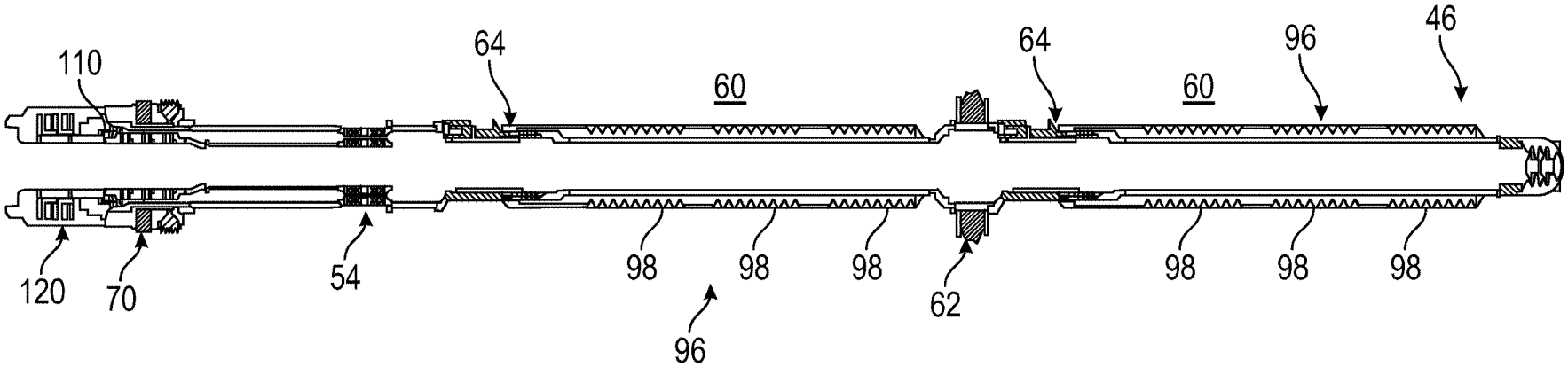
FIG. 10 is a cross-sectional schematic view of another example of an electric completion system for use in a borehole, e.g. a wellbore, according to an embodiment of the disclosure.

The outflow of fluid 108 may be controlled electrically and independently at each well zone 60 via corresponding electric flow control valves 64. In this embodiment, electric power may be communicated throughout the lower completion 46 from the surface and/or from a suitable downhole power device 78 via inductive coupler 54. According to some applications, a portion of the inductive coupler 54 may be mounted to a liner hanger running tool 110. Various sensors 68, e.g. pressure and temperature sensors, may be utilized along the lower completion 46 and various combinations of electrical and fiber-optic lines may be utilized in constructing the desired data highway. For this type of architecture, washdown capability is achieved without requiring a wash pipe. In FIG. 10, a similar architecture is illustrated but this embodiment employs screens 98 in the form of standalone screens rather than the multizone screens illustrated in FIG. 9.

Figure 11:
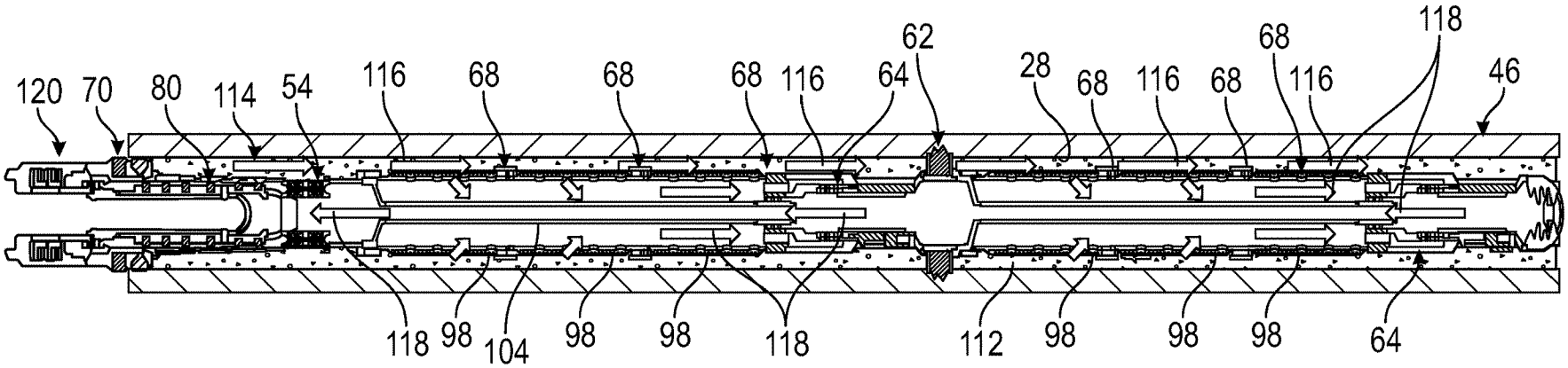
FIG. 11 is a cross-sectional schematic view of another example of an electric completion system for use in a borehole, e.g. a wellbore, according to an embodiment of the disclosure.
Figure 12:
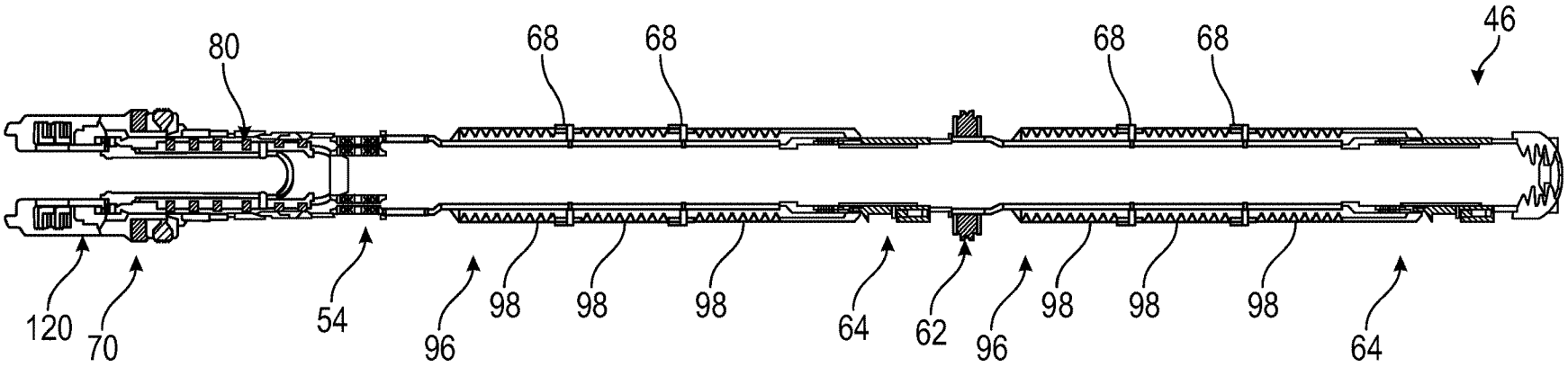
FIG. 12 is a cross-sectional schematic view of another example of an electric completion system for use in a borehole, e.g. a wellbore, according to an embodiment of the disclosure.

Referring generally to FIGS. 11 and 12, additional embodiments of electric lower completion 46 are illustrated. In FIG. 11, for example, the lower completion 46 is illustrated as arranged for production of well fluid which flows in through sand screen assemblies 96, and then into the interior of inner tubing string 104 via electric flow control valves 64. This arrangement enables independent, electric control over the inflow of production fluids from each well zone 60. It should be noted that prior to production a gravel pack 112 may be achieved by utilizing shunt tubes of an alternate path system 114 disposed along the sand control system/sand control assemblies 96, as indicated by arrows 116. Gravel pack return flow is indicated by arrows 118.

As with other embodiments, a variety of sensors 68, such as the illustrated pressure and temperature sensors, may be positioned at desired locations along the lower completion 46. In this embodiment, an electric power storage device 80, e.g. a battery, may be used, at least in part, to provide power to electrically powered components, such as the electric flow control valves 64, via inductive coupler 54. In some embodiments, wireless system 74 may be used to transmit data via, for example, an acoustic tool 120. In FIG. 12, a similar architecture is illustrated but this embodiment employs screens 98 in the form of standalone screens rather than the multizone screens illustrated in FIG. 11.

The various embodiments described with reference to FIGS. 1-12 provide examples of electric completion systems 42 which may be constructed for use in a variety of wellbores and well environments. The electrification of the various completion systems 42 provides for more efficient and capable production systems as well as systems which may be utilized in various other well operations, such as well preparation and treatment operations. By utilizing electric lines 52 instead of hydraulic control lines to operate subsurface safety valves, flow control valves, and/or various other downhole components, the electric completion systems 42 offer cost, simplicity, and dependability advantages for managing production, reducing subsea tree footprint, reducing umbilical complexity, increasing installation efficiency, and reducing risk during the production life of the well. As described above, various embodiments of the electric completion system 42 also simplify independent control over flow rates in each of the well zones 60 in multi well zone applications.

Depending on the parameters of a given well operation, the configuration of upper completion 44 and lower completion 46 may be adjusted. For example, various electric subsurface safety valves and electric flow control valves may be positioned at different locations along the overall electric completion system 42. Similarly, many types of electric control line systems 50 may be utilized with differing numbers of electric control lines 52.

Individual control lines 52 may be utilized for controlling multiple devices/components or may be utilized for the dedicated control of a single corresponding component. Additionally, the electric control line system 50 may incorporate optical fiber lines and various other types of transmission lines for telemetry or other data communication.

Similarly, multiple types of power sources may be used to provide electrical power from the surface and/or from downhole locations via an electrical storage device or electrical generation device. In some applications, wireless transmission of data and/or power may be achieved via wireless systems 74 disposed at single or multiple locations along the overall electric completion system 42. Depending on the production fluids and well environment, the completions may comprise many types of sand screen assemblies, gravel packing components, monitoring systems, inductive couplers, flow path arrangements, and other components or configurations selected according to the parameters of a given well operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a borehole, comprising:

an electric completion system having:

an upper completion including a production packer and a wireless system disposed above the production packer, the wireless system configured to provide communication of data between the electric completion system and a surface facility;

a lower completion coupled with the upper completion below the production packer of the upper completion by a coupling system that includes an inductive coupler and a hydraulic wet mate connection, the lower completion including a plurality of electric flow control valves positioned to control inflow and outflow of fluid with respect to the lower completion;

an electric line system deployed along the upper completion and along the lower completion to the plurality of electric flow control valves; and an electric subsurface safety valve, wherein the electric subsurface safety valve and the plurality of electric flow control valves are operable via power supplied downhole by the electric line system.

2. The system as recited in claim 1, wherein the electric completion system is an open hole electric completion system.

3. The system as recited in claim 1, wherein the lower completion comprises a sand control system.

4. The system as recited in claim 3, wherein the sand control system comprises a plurality of sand control assemblies positioned along corresponding well zones.

5. The system as recited in claim 1, wherein the lower completion comprises a plurality of isolation packers positioned to isolate a plurality of corresponding well zones disposed along the borehole.

6. The system as recited in claim 5, wherein the plurality of electric flow control valves comprises at least one electric flow control valve positioned to control flow with respect to each corresponding well zone.

7. The system as recited in claim 6, wherein a plurality of sensors is located along the lower completion.

8. The system as recited in claim 7, wherein the plurality of sensors comprises at least one sensor positioned in each corresponding well zone.

9. The system as recited in claim 1, wherein the electric subsurface safety valve is located along the upper completion.

10. The system as recited in claim 1, wherein the electric completion system further comprises a downhole power device coupled to the electric line system to provide electrical power to a plurality of devices located downhole, including the plurality of electric flow control valves.

11. The system as recited in claim 10, wherein the downhole power device comprises a power storage device.

12. The system as recited in claim 10, wherein the downhole power device comprises a power generation device.

13. A method, comprising:

assembling an electric completion system having inflow and outflow of fluid controlled by a plurality of electric flow control valves, wherein the electric completion system comprises a lower completion coupled with an upper completion below a production packer of the upper completion by a coupling system that includes an inductive coupler and a hydraulic wet mate connection, and wherein the plurality of electric valves is disposed in the lower completion;

deploying the electric completion system in a borehole;

utilizing a wireless system disposed above the production packer of the upper completion to provide communication of data between the electric completion system and a surface facility; and utilizing an electric line system deployed along the upper completion and along the lower completion to provide electric power to the plurality of electric valves.

14. The method as recited in claim 13, further comprising providing electric power to the electric line system from a downhole source.

15. The method as recited in claim 13, further comprising obtaining sensor data along a plurality of well zones via sensors disposed along the electric completion system.

16. The method as recited in claim 15, further comprising isolating the well zones of the plurality of well zones via isolation packers disposed along the electric completion system.

17. A system for use in a borehole, comprising:

a well system utilizing at least one electric power source to provide power for actuating each of a plurality of electronically controlled devices downhole, the well system comprising:

an electric completion system located in a wellbore, the electric completion system having:

a lower completion coupled with an upper completion below a production packer of the upper completion by a coupling system that includes an inductive coupler and a hydraulic wet mate connection, wherein a portion of the inductive coupler is mounted to a running tool extending through the production packer;

a plurality of electric valves positioned to control inflow of fluid from the wellbore and outflow of fluid to the wellbore, wherein the plurality of electric valves is disposed in the lower completion;

a plurality of pressure and temperature sensors disposed along the electric completion system; and a wireless system located along the electric completion system to provide wireless transmission of at least one of communication data and power with respect to at least one of the plurality of pressure and temperature sensors or the plurality of electric valves; and an electric line system disposed along the upper completion and along the lower completion to the plurality of electric valves.

18. The system as recited in claim 17, wherein the lower completion is substantially disposed within a horizontal section of the wellbore.

19. The system as recited in claim 17, wherein the electric line system is disposed along the upper completion and along the lower completion to carry both communication data and power.

20. The system as recited in claim 18, wherein the lower completion comprises a plurality of isolation packers positioned along the lower completion to isolate a plurality of corresponding well zones.

* * * * *